US007980001B2

(12) United States Patent
Trinh et al.

(10) Patent No.: US 7,980,001 B2
(45) Date of Patent: Jul. 19, 2011

(54) FABRIC CONDITIONING DISPENSER AND METHODS OF USE

(75) Inventors: Toan Trinh, Maineville, OH (US); Samuel James Morris, III, Cincinnati, OH (US); Lawrence Andrew Schumacher, Trenton, OH (US); John William Smith, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 786 days.

(21) Appl. No.: 11/059,061

(22) Filed: Feb. 16, 2005

(65) Prior Publication Data

US 2005/0229653 A1 Oct. 20, 2005

Related U.S. Application Data

(60) Provisional application No. 60/555,950, filed on Mar. 24, 2004, provisional application No. 60/548,374, filed on Feb. 27, 2004, provisional application No. 60/550,555, filed on Mar. 5, 2004, provisional application No. 60/550,669, filed on Mar. 5, 2004, provisional application No. 60/550,557, filed on Mar. 5, 2004, provisional application No. 60/555,860, filed on Mar. 24, 2004, provisional application No. 60/560,121, filed on Apr. 7, 2004, provisional application No. 60/591,032, filed on Jul. 26, 2004.

(51) Int. Cl.
*F26B 3/00* (2006.01)

(52) U.S. Cl. ..... 34/90; 34/105; 34/210; 34/104; 34/217; 521/55; 604/358; 604/368; 510/502; 510/520; 206/5; 206/524.6; 8/148

(58) Field of Classification Search ..... 34/90, 104, 34/105, 210; 521/55; 604/358, 368; 8/148; 206/5, 524.6; 510/502, 520
See application file for complete search history.

(56) References Cited

U.S. PATENT DOCUMENTS

| | | | | |
|---|---|---|---|---|
| 3,043,015 | A * | 7/1962 | Brucken | 34/80 |
| 3,076,206 | A * | 2/1963 | Shaw et al. | 441/104 |
| 3,159,465 | A * | 12/1964 | Morey | 34/527 |
| 3,197,884 | A * | 8/1965 | Smith | 34/532 |
| 3,242,584 | A * | 3/1966 | Jacobs | 34/448 |
| 3,267,701 | A * | 8/1966 | Mandarino | 68/12.15 |
| 3,394,467 | A * | 7/1968 | Janke | 34/532 |
| 3,435,537 | A | 4/1969 | Rumsey, Jr. | |
| 3,634,947 | A | 1/1972 | Furgal | |
| 3,676,199 | A | 7/1972 | Hewitt et al. | |
| 3,696,034 | A | 10/1972 | Hewitt et al. | |
| 3,698,095 | A | 10/1972 | Grand et al. | |
| 3,702,030 | A * | 11/1972 | Janke | 34/498 |
| 3,736,668 | A | 6/1973 | Dillarstone | |
| 3,870,145 | A * | 3/1975 | Mizuno | 206/0.5 |
| 3,945,936 | A * | 3/1976 | Lucas et al. | 252/186.2 |
| 3,947,971 | A | 4/1976 | Bauer | |
| 3,948,387 | A | 4/1976 | Haertle | |
| 3,967,008 | A | 6/1976 | Mizuno et al. | |
| 3,977,980 | A | 8/1976 | Fry et al. | |

(Continued)

FOREIGN PATENT DOCUMENTS

CA 1021559 11/1977

(Continued)

*Primary Examiner* — Stephen M. Gravini
(74) *Attorney, Agent, or Firm* — Gary J. Foose; David V. Upite; Leonard W. Lewis

(57) ABSTRACT

Fabric conditioner dispensers capable of being maintained with one hand.

2 Claims, 6 Drawing Sheets

U.S. PATENT DOCUMENTS

| | | | | | |
|---|---|---|---|---|---|
| 4,004,685 | A | | 1/1977 | Mizuno et al. | |
| 4,012,326 | A | | 3/1977 | Rudy et al. | |
| 4,014,105 | A | * | 3/1977 | Furgal et al. | 34/389 |
| 4,014,432 | A | | 3/1977 | Clothier et al. | |
| 4,035,307 | A | | 7/1977 | Fry et al. | |
| 4,041,205 | A | | 8/1977 | Compa et al. | |
| 4,053,992 | A | | 10/1977 | Furgal | |
| 4,057,673 | A | | 11/1977 | Falivene | |
| 4,098,937 | A | | 7/1978 | Mizuno et al. | |
| 4,105,813 | A | | 8/1978 | Mizuno | |
| 4,108,600 | A | | 8/1978 | Wong | |
| 4,130,392 | A | * | 12/1978 | Diehl et al. | 8/101 |
| 4,137,345 | A | | 1/1979 | Falivene | |
| 4,149,977 | A | | 4/1979 | Morganson et al. | |
| 4,214,038 | A | * | 7/1980 | McCarty et al. | 427/242 |
| 4,223,029 | A | | 9/1980 | Mahler et al. | |
| 4,231,166 | A | * | 11/1980 | McMillan | 34/553 |
| 4,254,139 | A | * | 3/1981 | Hendrickson et al. | 428/60 |
| 4,259,373 | A | * | 3/1981 | Demessemaekers et al. | 427/242 |
| 4,328,110 | A | | 5/1982 | Green | |
| 4,342,278 | A | * | 8/1982 | Horan | 114/345 |
| 4,385,452 | A | * | 5/1983 | Deschaaf et al. | 34/562 |
| 4,422,247 | A | * | 12/1983 | Deschaaf | 34/550 |
| 4,423,105 | A | * | 12/1983 | Dillarstone et al. | 428/198 |
| 4,460,644 | A | * | 7/1984 | Pavlich | 428/314.4 |
| 4,507,080 | A | * | 3/1985 | Freze | 432/105 |
| 4,511,495 | A | * | 4/1985 | Melville | 510/520 |
| 4,532,719 | A | * | 8/1985 | Davies et al. | 34/389 |
| 4,532,722 | A | * | 8/1985 | Sax | 34/60 |
| 4,567,675 | A | * | 2/1986 | Rennie | 34/60 |
| 4,597,191 | A | * | 7/1986 | Juzefczyk | 34/60 |
| 4,642,258 | A | | 2/1987 | Majewski et al. | |
| 4,642,908 | A | * | 2/1987 | Brenner | 34/60 |
| 4,706,802 | A | * | 11/1987 | Leigh et al. | 206/0.5 |
| 4,749,596 | A | * | 6/1988 | Evans et al. | 427/242 |
| 4,769,159 | A | | 9/1988 | Copeland | |
| 4,808,086 | A | * | 2/1989 | Evans et al. | 510/517 |
| 4,849,257 | A | * | 7/1989 | Borcher et al. | 427/242 |
| 4,891,890 | A | * | 1/1990 | Church | 34/389 |
| 4,920,662 | A | * | 5/1990 | Seeburger | 34/60 |
| 5,020,240 | A | | 6/1991 | Lee | |
| 5,116,656 | A | * | 5/1992 | Morris et al. | 510/105 |
| 5,375,552 | A | * | 12/1994 | Scott | 114/363 |
| 5,480,567 | A | | 1/1996 | Lam et al. | |
| 5,500,137 | A | | 3/1996 | Bacon et al. | |
| 5,509,915 | A | * | 4/1996 | Hanson et al. | 604/378 |
| 5,510,042 | A | | 4/1996 | Hartman et al. | |
| 5,540,168 | A | * | 7/1996 | Pettus | 114/39.23 |
| 5,668,094 | A | | 9/1997 | Bacon et al. | |
| 5,675,911 | A | * | 10/1997 | Moser | 34/389 |
| 5,687,591 | A | * | 11/1997 | Siklosi et al. | 68/212 |
| 5,787,606 | A | | 8/1998 | Bokholdt | |
| 5,855,454 | A | * | 1/1999 | Courtney et al. | 405/186 |
| 5,940,988 | A | * | 8/1999 | Eisen | 34/596 |
| 5,966,831 | A | * | 10/1999 | Anderson | 34/60 |
| 6,022,430 | A | * | 2/2000 | Blenke et al. | 156/73.1 |
| 6,022,431 | A | * | 2/2000 | Blenke et al. | 156/73.1 |
| 6,022,432 | A | * | 2/2000 | Elsberg et al. | 156/73.1 |
| 6,036,805 | A | * | 3/2000 | McNichols | 156/227 |
| 6,142,983 | A | * | 11/2000 | Suprise et al. | 604/385.03 |
| 6,243,969 | B1 | * | 6/2001 | Yeazell | 34/340 |
| 6,287,287 | B1 | * | 9/2001 | Elsberg | 604/385.03 |
| 6,357,137 | B1 | * | 3/2002 | Childs et al. | 34/63 |
| 6,482,422 | B1 | * | 11/2002 | Paul et al. | 424/402 |
| 6,503,525 | B1 | * | 1/2003 | Paul et al. | 424/402 |
| 6,530,725 | B1 | * | 3/2003 | Courtney et al. | 405/186 |
| 6,534,074 | B2 | * | 3/2003 | Krzysik et al. | 424/402 |
| 6,558,082 | B1 | * | 5/2003 | Courtney et al. | 405/186 |
| 6,558,363 | B2 | * | 5/2003 | Keuhn, Jr. et al. | 604/385.01 |
| 6,565,581 | B1 | * | 5/2003 | Spence et al. | 606/153 |
| 6,583,722 | B2 | * | 6/2003 | Jeutter et al. | 340/573.1 |
| 6,603,403 | B2 | * | 8/2003 | Jeutter et al. | 340/604 |
| 6,666,622 | B1 | * | 12/2003 | Courtney et al. | 405/186 |
| 6,687,339 | B2 | * | 2/2004 | Martin | 379/88.14 |
| 6,702,801 | B2 | * | 3/2004 | Van Gompel et al. | 604/385.22 |
| 6,884,251 | B2 | * | 4/2005 | Spence et al. | 606/153 |
| 6,887,841 | B2 | * | 5/2005 | Mattia et al. | 510/520 |
| 6,899,281 | B1 | * | 5/2005 | Griese et al. | 239/60 |
| 6,965,816 | B2 | * | 11/2005 | Walker | 701/16 |
| 7,055,761 | B2 | * | 6/2006 | Griese et al. | 239/60 |
| 7,056,179 | B2 | * | 6/2006 | Courtney | 441/90 |
| 7,066,412 | B2 | * | 6/2006 | Conley et al. | 239/690 |
| 7,093,772 | B2 | * | 8/2006 | Griese et al. | 239/43 |
| 7,285,090 | B2 | * | 10/2007 | Stivoric et al. | 600/300 |
| 7,311,267 | B2 | * | 12/2007 | Griese et al. | 239/43 |
| 7,462,035 | B2 | * | 12/2008 | Lee et al. | 439/37 |
| 7,556,532 | B2 | * | 7/2009 | Lee et al. | 439/620.04 |
| 7,658,612 | B2 | * | 2/2010 | Lee et al. | 439/37 |
| 7,730,568 | B2 | * | 6/2010 | Wong et al. | 8/148 |
| 7,731,517 | B2 | * | 6/2010 | Lee et al. | 439/271 |
| 7,753,685 | B2 | * | 7/2010 | Lee et al. | 439/37 |
| 7,813,025 | B2 | * | 10/2010 | Ribi | 359/288 |
| RE42,149 | E | * | 2/2011 | Courtney et al. | 405/186 |
| 2001/0014350 | A1 | * | 8/2001 | Krzysik et al. | 424/443 |
| 2001/0033639 | A1 | * | 10/2001 | Martin | 379/88.14 |
| 2001/0039405 | A1 | * | 11/2001 | Keuhn et al. | 604/360 |
| 2002/0010454 | A1 | * | 1/2002 | Van Gompel et al. | 604/385.22 |
| 2002/0042600 | A1 | * | 4/2002 | Datta et al. | 604/385.13 |
| 2002/0070864 | A1 | * | 6/2002 | Jeutter et al. | 340/573.1 |
| 2002/0070868 | A1 | * | 6/2002 | Jeutter et al. | 340/604 |
| 2002/0078589 | A1 | | 6/2002 | Hagemann et al. | |
| 2002/0138064 | A1 | * | 9/2002 | Datta et al. | 604/391 |
| 2003/0004487 | A1 | * | 1/2003 | Gompel et al. | 604/385.16 |
| 2003/0036489 | A1 | * | 2/2003 | Liu et al. | 510/100 |
| 2003/0071075 | A1 | * | 4/2003 | Frankenbach et al. | 222/383.1 |
| 2003/0093187 | A1 | * | 5/2003 | Walker | 701/1 |
| 2003/0097107 | A1 | * | 5/2003 | Sprengard-Eichel et al. | 604/378 |
| 2003/0120249 | A1 | * | 6/2003 | Wulz et al. | 604/385.101 |
| 2003/0120329 | A1 | * | 6/2003 | Getsla et al. | 607/149 |
| 2003/0149373 | A1 | * | 8/2003 | Reade et al. | 600/544 |
| 2003/0149411 | A1 | * | 8/2003 | Keuhn et al. | 604/367 |
| 2003/0153932 | A1 | * | 8/2003 | Spence et al. | 606/153 |
| 2003/0192197 | A1 | | 10/2003 | Griese et al. | |
| 2003/0194277 | A1 | * | 10/2003 | Courtney | 405/186 |
| 2004/0002270 | A1 | * | 1/2004 | Courtney | 441/40 |
| 2004/0038842 | A1 | * | 2/2004 | Fagg et al. | 510/295 |
| 2004/0045187 | A1 | * | 3/2004 | Curry et al. | 34/595 |
| 2004/0089731 | A1 | * | 5/2004 | Griese et al. | 239/43 |
| 2004/0133081 | A1 | * | 7/2004 | Teller et al. | 600/300 |
| 2004/0152957 | A1 | * | 8/2004 | Stivoric et al. | 600/300 |
| 2004/0159006 | A1 | * | 8/2004 | Griese et al. | 34/444 |
| 2004/0159717 | A1 | * | 8/2004 | Griese et al. | 239/43 |
| 2004/0159718 | A1 | * | 8/2004 | Griese et al. | 239/43 |
| 2004/0254549 | A1 | * | 12/2004 | Olson et al. | 604/361 |
| 2004/0258481 | A1 | * | 12/2004 | Courtney et al. | 405/186 |
| 2004/0260470 | A1 | * | 12/2004 | Rast | 701/300 |
| 2005/0080520 | A1 | * | 4/2005 | Kline et al. | 701/1 |
| 2005/0132755 | A1 | * | 6/2005 | Sundell et al. | 68/3 R |
| 2005/0148985 | A1 | * | 7/2005 | Bronk et al. | 604/387 |
| 2005/0187677 | A1 | * | 8/2005 | Walker | 701/16 |
| 2005/0192203 | A1 | * | 9/2005 | Trinh | 510/515 |
| 2005/0192205 | A1 | * | 9/2005 | Trinh et al. | 510/520 |
| 2005/0210627 | A1 | * | 9/2005 | Luebbering et al. | 15/410 |
| 2005/0229653 | A1 | * | 10/2005 | Trinh et al. | 68/237 |
| 2006/0026017 | A1 | * | 2/2006 | Walker | 705/1 |
| 2006/0047705 | A1 | * | 3/2006 | Reade et al. | 707/104.1 |
| 2006/0069379 | A1 | * | 3/2006 | Van Gompel et al. | 604/391 |
| 2006/0107552 | A1 | * | 5/2006 | Clark et al. | 36/97 |
| 2006/0107553 | A1 | * | 5/2006 | Clark et al. | 36/97 |
| 2006/0206246 | A1 | * | 9/2006 | Walker | 701/16 |
| 2006/0277785 | A1 | * | 12/2006 | Vattes et al. | 36/3 A |
| 2006/0277786 | A1 | * | 12/2006 | Vattes et al. | 36/3 A |
| 2006/0277787 | A1 | * | 12/2006 | Vattes et al. | 36/3 A |
| 2007/0011914 | A1 | * | 1/2007 | Keen et al. | 36/50.1 |
| 2007/0026695 | A1 | * | 2/2007 | Lee et al. | 439/37 |
| 2007/0032769 | A1 | * | 2/2007 | Cohen et al. | 604/385.06 |
| 2007/0088303 | A1 | * | 4/2007 | Olson et al. | 604/385.01 |
| 2007/0105404 | A1 | * | 5/2007 | Lee et al. | 439/37 |
| 2007/0142805 | A1 | * | 6/2007 | Gompel et al. | 604/385.01 |
| 2007/0207186 | A1 | * | 9/2007 | Scanlon et al. | 424/424 |
| 2007/0233026 | A1 | * | 10/2007 | Roe et al. | 604/361 |
| 2007/0233028 | A1 | * | 10/2007 | Roe et al. | 604/361 |
| 2007/0273951 | A1 | * | 11/2007 | Ribi | 359/237 |
| 2007/0283505 | A1 | * | 12/2007 | Wong et al. | 8/149.3 |
| 2007/0283509 | A1 | * | 12/2007 | Wong et al. | 8/149.3 |
| 2007/0283728 | A1 | * | 12/2007 | Wong et al. | 68/5 R |
| 2007/0287971 | A1 | * | 12/2007 | Roe et al. | 604/361 |

| | | | | |
|---|---|---|---|---|
| 2008/0004582 | A1* | 1/2008 | Lodge et al. | 604/385.01 |
| 2008/0004583 | A1* | 1/2008 | Desai et al. | 604/385.01 |
| 2008/0004584 | A1* | 1/2008 | Langdon et al. | 604/385.01 |
| 2008/0004586 | A1* | 1/2008 | Lodge et al. | 604/385.03 |
| 2008/0004587 | A1* | 1/2008 | Lodge et al. | 604/385.03 |
| 2008/0004589 | A1* | 1/2008 | Roe et al. | 604/396 |
| 2008/0004590 | A1* | 1/2008 | Lodge et al. | 604/396 |
| 2008/0004591 | A1* | 1/2008 | Desai et al. | 604/396 |
| 2008/0004592 | A1* | 1/2008 | Lodge et al. | 604/396 |
| 2008/0004593 | A1* | 1/2008 | Lodge et al. | 604/401 |
| 2008/0015135 | A1* | 1/2008 | de Buzzaccarini et al. | 510/336 |
| 2008/0032909 | A1* | 2/2008 | de Buzzaccarini et al. | 510/293 |
| 2008/0072448 | A1* | 3/2008 | Hubig et al. | 34/446 |
| 2008/0110342 | A1* | 5/2008 | Ensor et al. | 96/54 |
| 2008/0125739 | A1* | 5/2008 | Lodge et al. | 604/385.03 |
| 2008/0147031 | A1* | 6/2008 | Long et al. | 604/361 |
| 2008/0161654 | A1* | 7/2008 | Teller et al. | 600/300 |
| 2008/0161655 | A1* | 7/2008 | Teller et al. | 600/300 |
| 2008/0167536 | A1* | 7/2008 | Teller et al. | 600/301 |
| 2008/0167537 | A1* | 7/2008 | Teller et al. | 600/301 |
| 2008/0167538 | A1* | 7/2008 | Teller et al. | 600/301 |
| 2008/0167539 | A1* | 7/2008 | Teller et al. | 600/301 |
| 2008/0171919 | A1* | 7/2008 | Stivoric et al. | 600/301 |
| 2008/0171920 | A1* | 7/2008 | Teller et al. | 600/301 |
| 2008/0171921 | A1* | 7/2008 | Teller et al. | 600/301 |
| 2008/0171922 | A1* | 7/2008 | Teller et al. | 600/301 |
| 2008/0188822 | A1* | 8/2008 | Lodge et al. | 604/385.03 |
| 2008/0274014 | A1* | 11/2008 | Jumonville et al. | 422/57 |
| 2008/0274495 | A1* | 11/2008 | Jumonville et al. | 435/30 |
| 2008/0275309 | A1* | 11/2008 | Stivoric et al. | 600/300 |
| 2009/0117753 | A1* | 5/2009 | Lee et al. | 439/37 |
| 2009/0149036 | A1* | 6/2009 | Lee et al. | 439/37 |
| 2009/0149037 | A1* | 6/2009 | Lee et al. | 439/37 |
| 2009/0162651 | A1* | 6/2009 | Rios et al. | 428/354 |
| 2009/0177068 | A1* | 7/2009 | Stivoric et al. | 600/365 |
| 2009/0205646 | A1* | 8/2009 | Tanaka et al. | 128/200.24 |
| 2009/0205648 | A1* | 8/2009 | Tanaka et al. | 128/200.24 |
| 2009/0205649 | A1* | 8/2009 | Tanaka et al. | 128/200.24 |
| 2009/0205650 | A1* | 8/2009 | Tanaka et al. | 128/200.24 |
| 2009/0205651 | A1* | 8/2009 | Tanaka et al. | 128/200.26 |
| 2009/0205658 | A1* | 8/2009 | Tanaka et al. | 128/203.15 |
| 2009/0209906 | A1* | 8/2009 | Tanaka et al. | 604/93.01 |
| 2009/0287282 | A1* | 11/2009 | Biser et al. | 607/109 |
| 2010/0030173 | A1* | 2/2010 | Song et al. | 604/361 |
| 2010/0031617 | A1* | 2/2010 | Ensor et al. | 55/487 |
| 2010/0064413 | A1* | 3/2010 | Koelle et al. | 2/113 |
| 2010/0102959 | A1* | 4/2010 | Ashrafzadeh et al. | 340/540 |
| 2010/0134257 | A1* | 6/2010 | Puleston et al. | 340/10.4 |
| 2010/0179496 | A1* | 7/2010 | Roe et al. | 604/368 |
| 2010/0179500 | A1* | 7/2010 | Roe et al. | 604/385.14 |
| 2010/0179501 | A1* | 7/2010 | Roe et al. | 604/385.14 |
| 2010/0183814 | A1* | 7/2010 | Rios et al. | 427/387 |
| 2010/0210745 | A1* | 8/2010 | McDaniel et al. | 521/55 |
| 2010/0222755 | A1* | 9/2010 | Westwood | 604/358 |
| 2010/0222761 | A1* | 9/2010 | Westwood et al. | 604/385.01 |
| 2010/0233146 | A1* | 9/2010 | McDaniel | 424/94.2 |

FOREIGN PATENT DOCUMENTS

| | | | | |
|---|---|---|---|---|
| DE | 2 350 574 | | | 4/1974 |
| EP | 0 000 416 | A1 | | 1/1979 |
| EP | 0 154 359 | B1 | | 9/1985 |
| EP | 194127 | A2 | * | 9/1986 |
| EP | 294886 | A2 | * | 12/1988 |
| EP | 379950 | A1 | * | 8/1990 |
| EP | 392606 | A1 | * | 10/1990 |
| EP | 392607 | A1 | * | 10/1990 |
| EP | 831147 | A2 | * | 3/1998 |
| EP | 1396260 | A1 | * | 3/2004 |
| EP | 1813706 | A1 | * | 8/2007 |
| GB | 2013260 | A | * | 8/1979 |
| JP | 59073053 | A | * | 4/1984 |
| JP | 01162871 | A | * | 6/1989 |
| JP | 03014679 | A | * | 1/1991 |
| WO | WO 9422999 | A1 | * | 10/1994 |
| WO | WO 9507342 | A1 | * | 3/1995 |
| WO | WO 9620998 | A1 | * | 7/1996 |
| WO | WO 9725398 | A1 | * | 7/1997 |
| WO | WO 9726316 | A1 | * | 7/1997 |
| WO | WO 9741205 | A1 | * | 11/1997 |
| WO | WO 9900347 | A1 | * | 1/1999 |
| WO | WO 9900377 | A1 | * | 1/1999 |
| WO | WO 0136574 | A1 | * | 5/2001 |
| WO | WO 02090480 | A1 | * | 11/2002 |
| WO | WO 03/087282 | A1 | | 10/2003 |
| WO | WO 03/087463 | A1 | | 10/2003 |
| WO | WO 2007120867 | A2 | * | 10/2007 |
| WO | WO 2007135638 | A1 | * | 11/2007 |

* cited by examiner

FABRIC CONDITIONING DISPENSER AND METHODS OF USE

CROSS REFERENCE TO RELATED APPLICATIONS

This application claims benefit to the following U.S. Provisional Patent Applications: 60/548,374, filed Feb. 27, 2004; 60/550,555, filed Mar. 5, 2004; 60/550,669, filed Mar. 5, 2004; 60/550,557, filed Mar. 5, 2004; 60/555,860, filed Mar. 24, 2004; 60/560,121, filed Apr. 7, 2004; and 60/591,032, filed Jul. 26, 2004, the disclosures of which are all hereby incorporated by reference.

FIELD OF THE INVENTION

The invention relates to an improved multiple use fabric conditioner dispenser and to methods of using and manufacturing the same.

BACKGROUND OF THE INVENTION

Dryer-added fabric conditioning products provide a better convenience to the consumer as compared to the rinse-added fabric conditioning products because they spare the consumer the requirement of having to be present at the beginning of the rinse cycle.

There are two main types of dryer-added fabric conditioning products, namely, single use products and multiple-use products. Single use products, most commonly in the sheet form coated with a fabric conditioning composition, calls for adding a single sheet into an automatic clothes dryer containing a wet laundry load at the beginning of the drying cycle. Examples of this type of product are disclosed in U.S. Pat. No. 3,442,692 to Gaiser and U.S. Pat. No. 3,686,025 to Morton et al.

Multiple use fabric conditioning products are placed in the interior of the dryer to release the fabric conditioning active to successive laundry loads. Each multiple-use product lasts many drying cycles, from a few cycles to about 50 or more cycles. Said product can either be an unattached article that is added to an automatic clothes dryer and is tumbled along with a wet laundry load, or an article that is releasably attached to the interior of an automatic dryer drum. An example of an unattached multiple use fabric conditioning article is disclosed in U.S. Pat. No. 3,676,199 issued Jul. 11, 1972 to Hewitt et al.

The products can be attached to the interior of the dryer, as disclosed in U.S. Pat. Appl. Publ. No. 2003/0192197 A1 published Oct. 16, 2003 to Griese et al., and U.S. Pat. Appl. Publ. No. 2003/0195130 A1 published Oct. 16, 2003 to Lentsch et al. The softener active, which is preferably solid at room temperature, can soften or melt under the clothes dryer operating temperature, such as those disclosed in U.S. Pat No. 3,696,034, or only softens at a temperature above the clothes dryer operating temperature, such as those disclosed in U.S. Pat. Appl. Publ. Nos. 2003/0192197 and 2003/0195130 A1. In use, this type of article is attached to the inside wall of a dryer, such as on a dryer fin, and a wet laundry load is tumbled in the presence of said article while being dried in order to receive the conditioning benefits. After drying, the laundry is removed but the article is left in place and is ready for the next load of wet laundry for drying. This article provides increased convenience to the consumer as its use requires less effort to use than single use products while eliminating searching for unattached multiple use products after each drying cycle.

However, releasably attached multiple use fabric conditioning articles have presented users with an unexpected problem, in that it is difficult for a user to install the product and/or replace the product when it reaches the end of its effective life cycle, given that many household clothes dryers are placed rather low on the floor and have a rather small opening. Thus, it can be awkward and/or difficult for a user, especially a big, heavy-set, overweight, tall, and/or obese user, to bend down and use both hands and arms to install and/or replace the product in the interior of a clothes dryer.

The present invention relates to improvements to solve this unexpected problem.

SUMMARY OF THE INVENTION

A first aspect of the invention provides a fabric conditioner dispenser comprising a composition carrier capable of releasing a fabric conditioning composition wherein the fabric conditioning composition can be operatively attached to the composition carrier; and a docking member, wherein the docking member capable of being releasably attached to an inner surface of a clothes dryer, and wherein the composition carrier is operatively attached to the docking member; wherein said docking member is releasably attached to said inner surface of the dryer using one hand, and/or wherein said composition carrier is operatively attached to said docking member by using one hand.

In one embodiment, the composition carrier is operatively attached to the docking member by adhesive, glue, double sided tape, hook and loop fasteners, reclosable fasteners, magnets, snap fits, fin/fin receiving members, mating members, or combinations thereof In another embodiment, the docking member is operatively attached to the composition carrier by lip, hole plug, segment, securing tap, fin/fin receiving members, or combinations thereof In yet another embodiment, the docking member is releasably attached to the inner surface of a clothes dryer by adhesive, glue, double sided tape, hook and loop fasteners, reclosable fasteners, magnets, snap fits, or combinations thereof In one embodiment, the composition carrier has one or more apertures. In another embodiment, the one or more apertures have an individual surface area from about 2 $mm^2$ to about 300 $mm^2$. In yet another embodiment, the one or more apertures have an individual surface area from about 4 $mm^2$ to about 150 $mm^2$. In still another embodiment, the one or more apertures have a shape selected from circular, ovoid, elliptical, triangular, square, rectangular, parallelepiped, pentagonal, hexagonal, heptagonal, octagonal, nonagonal, and decagonal.

In one embodiment, the docking member is made from a plastic selected from nylon, polypropylene, polyethylene, and combinations thereof In another embodiment, the composition carrier is made from a plastic selected from nylon, polypropylene, polyethylene, and combinations thereof.

In one embodiment, the composition carrier comprises an indicium. In another embodiment, the indicium is chosen from a word, phrase, letter, character, brand name, company name, company logo or symbol, description, logo, icon, perfume name, design, designer name, symbol, motif, insignia, figure, mark, signal, color, texture, shape, token, advertisement, and combinations thereof In yet another embodiment, the indicium is chosen from a word, phrase, brand name, company name, description, perfume name, designer name, advertisement, and combinations thereof, and wherein said indicium is in one or more than one language.

A second aspect of this invention provides a method of performing general maintenance on a fabric conditioner composition comprising: a. opening a dryer to expose an inner surface of the dryer, b. attaching a fabric conditioner dispenser to the inner surface of the dryer, and c. providing instructions to communicate to a user to perform the attaching of the fabric conditioner dispenser to the inner surface of the dryer with one hand.

In one embodiment, the method further comprises providing instructions to communicate to the user to use a second hand to stabilize and/or support the user.

A third aspect of this invention provides a method of performing general maintenance on a fabric conditioner composition comprising: a. opening a dryer to expose an inner surface of the dryer containing the fabric conditioner dispenser having a first composition carrier and a docking member, b. removing the first composition carrier from the docking member, and c. inserting a second composition carrier into the docking member, and d. providing instructions to communicate to a user to perform the removing and inserting with one hand.

In one embodiment, the method further comprises providing instructions to communicate to the user to use a second hand to stabilize and/or support the user.

In one embodiment, an article of manufacture comprising a multiple use fabric conditioner dispenser comprising the composition carrier and the docking member, in a package, and a set of instructions associated with the package, wherein the set of instructions comprises at least one instruction to direct a user to perform with one hand at least one task selected from: attaching the docking member to the inner surface of the dryer; attaching a composition carrier to the inner surface of the dryer; replacing a spent fabric conditioning block with a new fabric condition block, or combinations thereof.

BRIEF DESCRIPTION OF THE DRAWINGS

The invention may take form in various components and arrangements of components, and in various steps and arrangement of steps. The drawings are only for purposes of illustrating the preferred embodiments and are not to be construed as limiting the invention.

DETAILED DESCRIPTION OF THE INVENTION

Figure 1A:
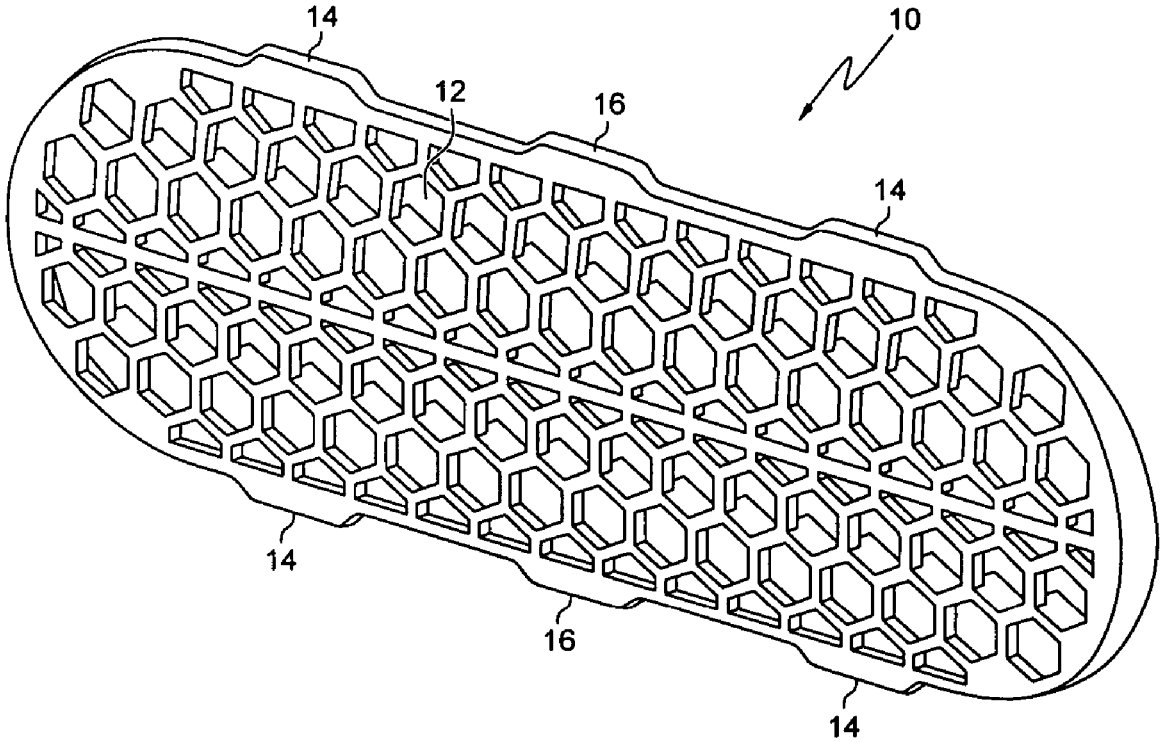
FIG. 1*a* is a perspective view of a first docking member.

While the specification concludes with the claims particularly pointing and distinctly claiming the invention, it is believed that the present invention will be better understood from the following description.

The compositions of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

All percentages and ratios used herein are by weight of the total composition and all measurements made are at 25° C., unless otherwise designated. An angular degree is a planar unit of angular measure equal in magnitude to 1/360 of a complete revolution.

All measurements used herein are in metric units unless otherwise specified.

It has now surprisingly been discovered that fabric conditioner dispenser of the present invention can be releasably attached within a clothes dryer using only one hand. Further, the composition carrier of the present invention can be releasably attached to the docking member, and the docking member can be releasably attached to the inner surface of a dryer using only one hand.

Without wishing to be bound by theory, it is believed that a user of the fabric conditioner dispenser, particularly a big, heavy-set, overweight, tall, and/or obese user can place the docking member of the fabric conditioning dispenser on the inner surface of the dryer as well as attach the composition carrier of the fabric conditioning dispenser to the docking member while using a second hand to stabilize and/or support the user by placing the second hand on the floor and/or the clothes drying machine. Additionally, servicing of the fabric conditioning dispenser is more easily accomplished as the composition carrier from the fabric conditioning dispenser maintenance using only one hand.

While the use of one hand to operate the present invention is described, it is anticipated that methods utilizing more than one hand from at least one user are contemplated. Further, it is contemplated that individuals having varying disabilities utilizing various hand substitutes such as artificial limbs or hooking or grasping mechanisms and the like are contemplated. Such an artificial limbs, hooking mechanisms, and/or grasping mechanism are considered as hands within the context of this invention. It is also contemplated that the left hand or the right hand can be used for the purpose of the present invention. The "second hand" refers to the hand that is not in use or in contact with the fabric conditioner dispenser.

Materials

The composition carrier and the docking member of the present invention can be made of any material capable of withstanding the heat and stresses of being located within an operational dryer for an extended period of time, such as more than one dryer cycle. Materials of construction include metals, ceramics, woods, laminates, plastics, and combinations. In one embodiment, the composition carrier and the docking member are made of plastics. In yet another embodiment, the composition carrier and the docking member are made from a plastic having a high melting point, including, but not limited to nylon, polypropylene, polyethylene, and combinations thereof Docking Member The docking member of the present invention is capable of being releasably attached to the inner surface of a clothes dryer. Methods of releasably attaching the docking member to the inner surface of a clothes dryer include adhesive, glue, double sided tape (e.g., 3M, part number 4084), VELCRO®, hook and loop fasteners, reclosable fasteners, magnets, snap fits, or other connecting means known in the art. In one embodiment, the method of releasably attaching the docking member to the inner surface of a clothes dryer is performable with one hand.

Composition Carrier

The composition carrier of the present invention is capable of releasing a fabric conditioning composition. In one embodiment, the composition carrier is substantially non-porous. In another embodiment, the composition carrier contains one or more apertures within the composition carrier. In an embodiment, the one or more apertures have an individual surface area of from about 1 $mm^2$ to about 500 $mm^2$; in another embodiment from about 2 $mm^2$ to about 300 $mm^2$; in another embodiment from about 4 $mm^2$ to about 150 $mm^2$; and in another embodiment from about 5 $mm^2$ to about 80 $mm^2$. In another embodiment the one or more apertures have an individual surface area of greater than about 1 $mm^2$, in another embodiment greater than about 2 $mm^2$, in another embodiment greater than about 3 $mm^2$; and in another embodiment greater than about 4 $mm^2$. In yet another embodiment, the one or more apertures have an individual surface area from about less than 500 $mm^2$. The one or more apertures can be shaped in any fashion including but not limited to circular, ovoid, elliptical, triangular, square, rectangular, parallelepiped, pentagonal, hexagonal, heptagonal, octagonal, nonagonal, and decagonal.

The fabric conditioning composition is operably attached to the composition carrier such that the composition carrier can be sustainably released within a clothes dryer substantially throughout the drying cycle. In one embodiment, the fabric conditioning composition is a solid and is attached to the composition carrier while the fabric conditioning composition is in a melted, fluid, and/or molten state. In this embodiment, the melted, fluid, and/or molten fabric conditioning composition is abutted against the composition carrier and allowed to set, cool, dry, and/or harden. In an embodiment where the composition carrier has one or more apertures, the melted, fluid, and/or molten fabric conditioning composition can optionally be poured through the composition carrier into a mold where the fabric conditioning composition is abutted against the composition carrier.

The composition carrier of the present invention is operatively attached to the docking member. Ways of operatively attaching the composition carrier to the docking member include adhesive, glue, double sided tape (e.g., 3M, part number 4084), VELCRO®, hook and loop fasteners, reclosable fasteners, magnets, snap fits, fin/fin receiving members, combination thereof, and the like. In one embodiment, the method of operatively attaching the composition carrier to the docking member is performable with one hand. In another embodiment, the composition carrier of the present invention contains at least one fin. The fin of the present invention is capable of being inserted within at least one fin receiving member located on the docking member. In one embodiment, the fin of the present invention fits into the fin receiving member of the docking member is such a fashion that the composition carrier can be removed from the docking member with one hand. In an additional embodiment, one or more fins can be located over a recessed area or an opening. Such fins can be used to aid in removing the composition carrier from the docking member. Thus, it is not necessary that the fins and the fin receiving members be provided in a 1:1 ratio, though such a ratio is also contemplated. Without wishing to be bound by theory, it is believed that the fins and the fin receiving members are toleranced such that the fins and the fin receiving members flex or give, allowing a user to remove the composition carrier from the docking station with one had, while simultaneously providing a secure fitment for use within a clothes dryer.

In another embodiment at least two securing tabs are located on the docking member. In one embodiment, a securing tab is located on each end of the docking member. When the composition carrier is in place on the docking member, the securing tabs of the present invention are actuated by pressing the tab away from the composition carrier. By doing such, the composition carrier of the present invention is translatable across the docking station, allowing for its removal. By having two securing tabs located on the docking station that are opposed, the composition carrier can be removed in a forward and in a rearward fashion, allowing for increased flexibility when orienting the docking station on the inner surface of the dryer. It is believed that the securing tabs of the present invention function by holding or binding the sidewalls, edges, or borders of the composition carrier in place.

In a preferred embodiment, the composition carrier additionally includes an indicium. Suitable indicia that can be used in the present invention are disclosed in the co-filed U.S. Provisional Application No. 60/548,374, filed Feb. 27, 2004, entitled "IMPROVED MULTIPLE USE FABRIC CONDITIONING ARTICLE WITH REPLACEMENT INDICIUM" to Trinh et al., and references cited therein. The indicium is preferably chosen from a word, phrase, letter, character, brand name, company name, company logo or symbol, description, logo, icon, perfume name, design, designer name, symbol, motif, insignia, figure, mark, signal, color, texture, shape, token, advertisement, and combinations thereof, more preferably said indicium is chosen from a word, phrase, brand name, company name, description, perfume name, designer name, advertisement, and combinations thereof, and wherein said indicium is in one or more than one language.

Fabric Conditioning Compositions

"Fabric conditioning composition" means a composition that includes a fabric conditioning component, a carrier component, and optionally a perfume component, that is preferably substantially solid at the operating temperature of household and/or commercial clothes dryers (e.g., at about 90° C. or higher). Exemplary fabric conditioning components, carrier components, and perfume components are described in U.S. patent application US 2003/0195130 and references cited therein, co-filed U.S. Provisional Application No. 60/550,555, filed Mar. 5, 2004, entitled "MULTIPLE USE FABRIC CONDITIONING COMPOSITION WITH IMPROVED PERFUME", to Trinh et al., and references cited therein; and co-filed U.S. Provisional Application No. 60/550,557 filed Mar. 5, 2004, entitled "MULTIPLE USE FABRIC CONDITIONING COMPOSITION WITH BLOOMING PERFUME", to Morgan et al, and references cited therein. The fabric conditioning component provides fabric conditioning properties to laundry such as fabric softening or antistatic benefit. Non-limiting examples of the fabric conditioning component include methyl bis(tallowamidoethyl)-2-hydroxyethyl ammonium methyl sulfate, and methyl bis(hydrogenated tallowamidoethyl)-2-hydroxyethyl ammonium methyl sulfate, methyl bis (stearyloyloxyethyl)-2-hydroxyethyl ammonium methyl sulfate, dimethyl bis (stearyloyloxyethyl) ammonium methyl sulfate, methyl bis (hydrogenated tallowoyloxyethyl)-2-hydroxyethyl ammonium methyl sulfate, and mixtures thereof. Other fabric conditioning components and other optional ingredients may include one or more of: sanitizer, deodorizer, odor control agent, soil repellant, soil release agent, dye-transfer inhibitor, dye fixative agent, chlorine scavenging agent, chelant, fiber protecting polymer, fiber smoother, antimicrobial agent, fungicide, antioxidant, preservative, insect repellent, moth repellent, UV light absorber, optical brightener, wrinkle control agent, processing agent, and/or mold release agent.

The carrier component mixes with the fabric conditioning component and helps the fabric conditioning component resist transfer to laundry by melting during the drying operation. The carrier component is chosen so that the fabric conditioning composition exhibits a melting point or softening point that is above the operating temperature of the dryer. In most dryer operations, this means that the melting temperature of the fabric conditioning composition is above about 90°

C. The melting temperature or the softening temperature of the fabric conditioning composition can be above about 95° C., above about 100° C., above about 110° C., or above about 120° C. The melting temperature of the fabric conditioning composition can be below 200° C. Non-limiting examples of the carrier component include ethylene bisamides, primary alkylamides, alkanolamides, polyamides, alcohols containing at least 12 carbon atoms, alkoxylated alcohols containing at least 12 carbon atoms, carboxylic acids containing at least about 12 carbon atoms, derivatives thereof, and mixtures thereof The melting temperature of the fabric conditioning composition refers to the temperature at which the composition begins to flow under its own weight. As the fabric conditioning composition reaches its melting point, one will observe the composition undergoing a transfer from a solid discreet mass to a flowable liquid. Although a differential scanning calorimeter (DSC) measurement of the composition may reveal that certain portions or phases of the composition may exhibit melting at temperatures that are within the operating temperatures of a dryer, it should be understood that what is meant by the melting temperature of the composition is not the melting temperature of certain portions or phases within the composition, but the melting temperature of the composition as demonstrated by the composition being visibly observed as a flowable liquid. It is expected that the fabric conditioning composition may be provided as a solid mixture including multiple phases or as a solid solution including a single phase.

The softening temperature of the composition refers to the temperature at which the solid mass becomes easily deformable. For many exemplary compositions according to the invention, it is expected that the softening temperature will be a few degrees below the melting temperature.

Non-limiting examples of suitable fabric conditioning composition are described in U.S. 2003/0195130 A1 published Oct. 16, 2003 to Lentsch et al., and any continuation-in-part applications thereof.

Maintenance

In one embodiment, the maintenance of the fabric conditioner dispenser, including, but not limited to, installation, removal, recharging, and/or refilling of the fabric conditioner dispenser can be performed with one hand. The ability of using only one hand is very important but this need is not known or appreciated in the prior art. First, the ability of using one hand for the handling of the fabric conditioning dispenser of the present invention will improve ease and the convenience of use for most users. However, the ability of using only one hand for the handling of the fabric conditioning dispenser is of utmost important for a user who is big, heavy-set, tall, overweight, and/or obese, because it is difficult for them to place the docking member on the inner surface of the dryer as well as attach the composition carrier of the fabric conditioning dispenser to the docking member by putting both hands into the small opening of the household clothes dryer which is normally placed very low on the floor. Additionally, servicing of the fabric conditioning dispenser is more easily accomplished as the composition carrier from the fabric conditioning dispenser maintenance using only one hand. As such, the user is able to utilize the free hand for other tasks, such as stabilizing and/or supporting the user during maintenance.

As it is not intuitive for users to perform maintenance of the fabric conditioner dispenser with one hand, instructions are provided in one embodiment. These instructions provide words, pictorials, and the like demonstrating and/or explaining to the user how to properly perform general maintenance to the fabric conditioner dispenser. In another embodiment, such instructions can be provided in a kit along with fabric conditioner dispenser containing a fabric conditioning composition.

In one embodiment, an article is provided that includes a multiple use fabric conditioner dispenser having a composition carrier and a docking member, in a retail or commercial package, and a set of instructions associated with the package. Such instructions can appear on the outside of the package or on a sheet or other item in the package. Further, such instructions can be directly located on the bar as a label, or carved and/or molded into the grooves of the bar, e.g., a note on the bar stating "Install/replace with one hand" and the like. Such instructions include at least one instruction to direct a user to perform maintenance with one hand. Such maintenance tasks include, but are not limited to, attaching the docking member to the inner surface of the dryer; attaching a composition carrier to the inner surface of the dryer; replacing a spent fabric conditioning block with a new fabric condition block, or combinations thereof.

While it is contemplated that the instructions are printed on a label or contained on a paper product, it is also contemplated that the instructions may be delivered electronically via an electronic display located within the laundry room, the clothes dryer, or the edifice housing the clothes dryer. Further, it is also contemplated that these instructions can be provided in an audible form or presented in Braille or other forms of non-written communication. Also contemplated are instructions that are in languages other than English, e.g., French, Spanish, and the like.

EXAMPLES

The following are intended to be non-limiting examples further exemplifying various aspects of the present invention.

Figure 1B:
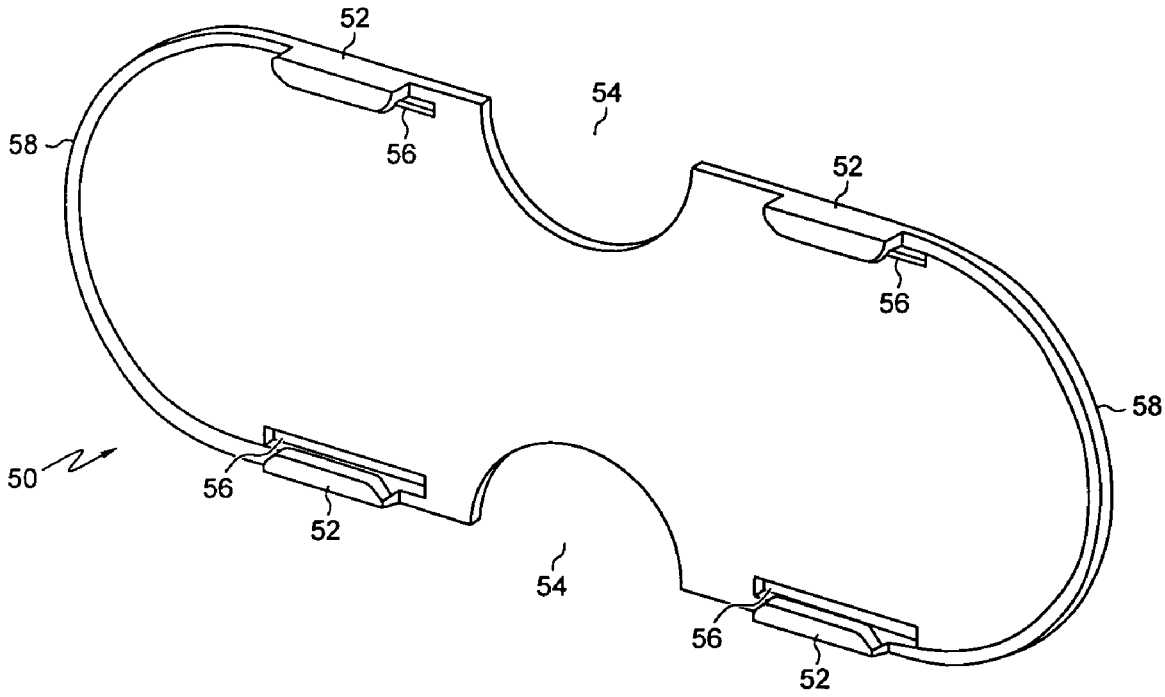
FIG. 1*b* is a perspective view of a first composition carrier.

FIGS. 1*a* and 1*b* illustrate a first fabric conditioner dispenser having a docking member 50 and a composition carrier 10, respectively. The docking member 50 contains fin receiving members 52 for receiving securing fins 14. Opening 54 allows a user to easily remove composition carrier 10 from docking member 50 by grasping and/or pulling maneuvering fin 16 to pull securing fins 14 away from or out of fin receiving members 52. Slots 56 provide for additional deformity of fin receiving members 52 to further aid in the attachment or removal of securing fins 14 when the composition carrier 10 is attached or removed from the docking member 50. Sidewall 58 provides additional securing of composition carrier 10 within docking member 50.

Figure 2A:
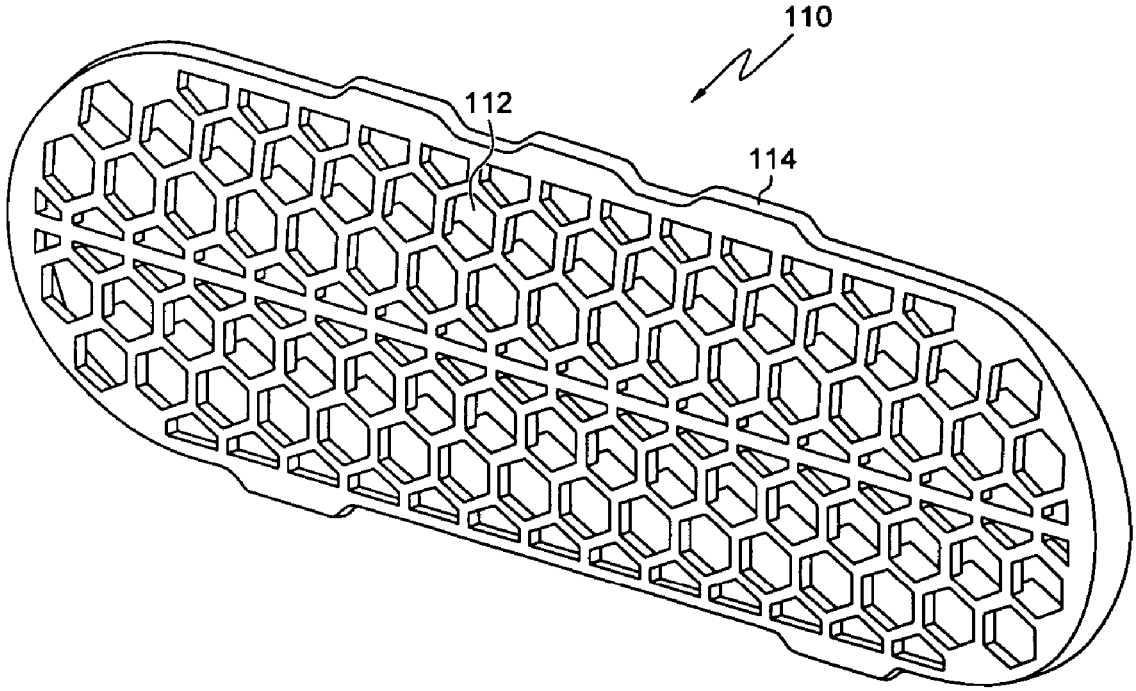
FIG. 2*a* is a perspective view of a second docking member.
Figure 2B:
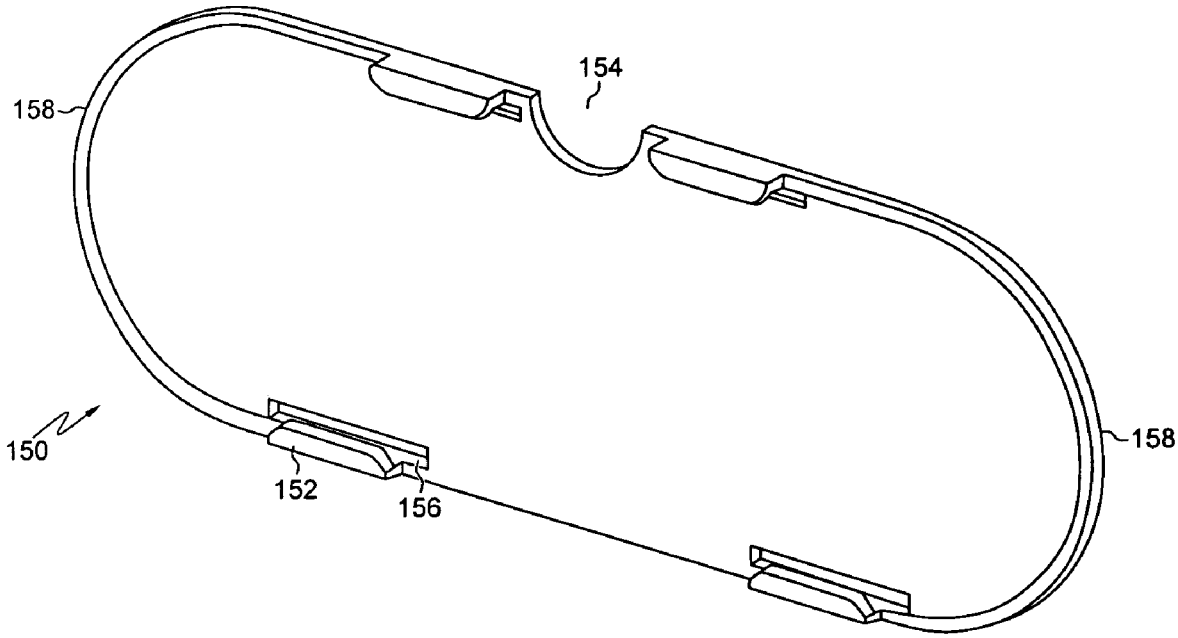
FIG. 2*b* is a perspective view of a second composition carrier.

FIGS. 2*a* and 2*b* illustrate a second fabric conditioner dispenser having a docking member 150 and a composition carrier 110, respectively. The docking member 150 contains fin receiving members 152 for receiving securing fins 114. Opening 154 allows a user to easily remove composition carrier 110 from docking member 150 by grasping and/or pulling maneuvering fin 116 to pull securing fins 114 away from or out of fin receiving members 152. Slots 156 provide for additional deformity of fin receiving members 152 to further aid in the attachment or removal of securing fins 114 when the composition carrier 110 is attached or removed from the docking member 150. Sidewall 158 provides additional securing of composition carrier 110 within docking member 150.

Figure 3A:
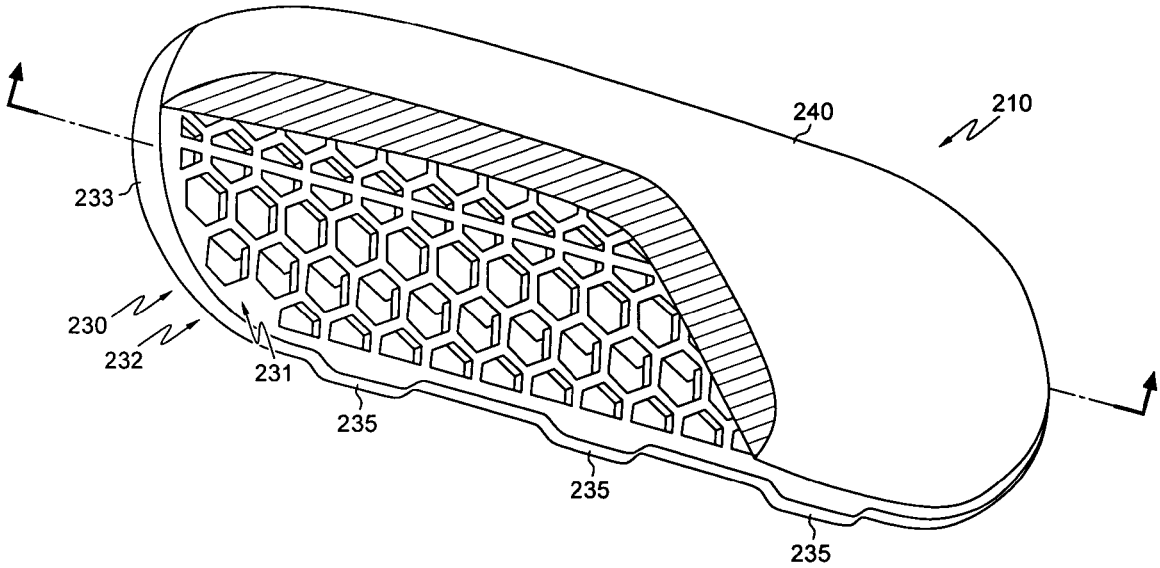
FIG. 3 is a perspective view of a fabric conditioning block and a docking member.
Figure 3B:
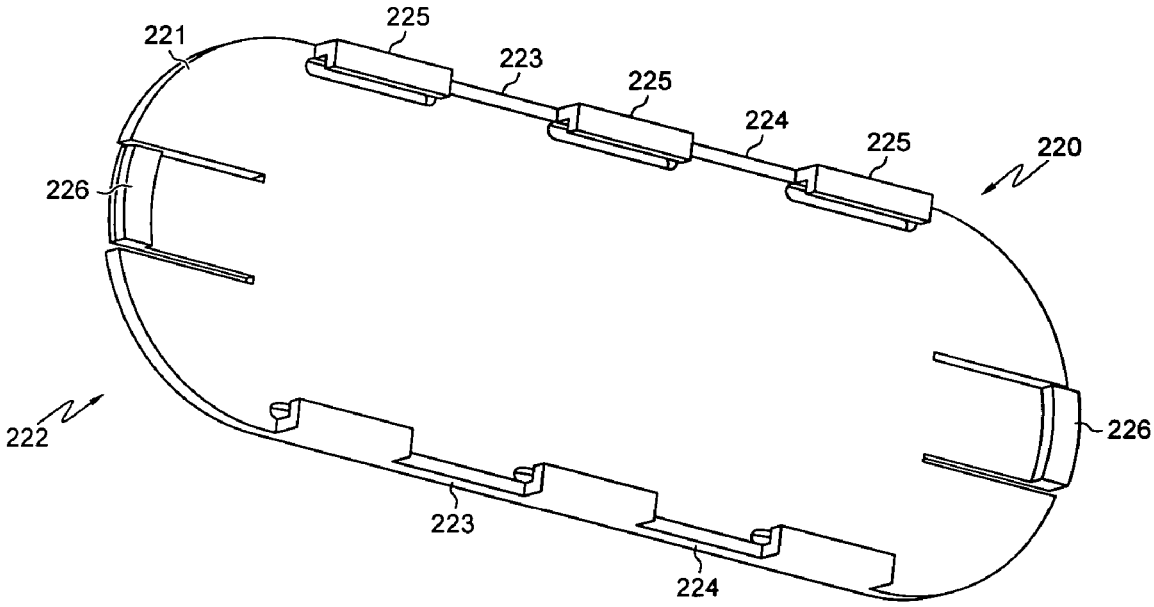

FIG. 3 is a perspective view of a multiple use fabric conditioning block 210 and a docking member 220. The fabric conditioning block 210 is made of a composition carrier 230 and a solid fabric conditioning composition 240. The composition carrier has a first side 231, a second side 232, and a circumferential third edge 233. The fabric conditioning composition 240 is operably connected to the composition carrier 230 by being fixedly cast or fixedly extruded to the composition carrier 230 such that the portion of the composition 240 coming into contact with laundry is located on the first side 231 of the composition carrier. The circumferential third edge 233 includes a connecting member in the form of securing fins 235 (including three securing fins opposing the three securing fins shown that are not shown) that protrude laterally out. When the solid fabric conditioning composition 240 is connected to the composition carrier 230, the second side 232 of the composition carrier is flat and planar.

In this embodiment, the composition carrier 230 is operably connectable to a docking member 220. The docking member 220 has a first side 221, a second side 222, and a perimeter 223. The second side 222 of the docking member 220 provides a surface onto which an adhesive or another docking member (not shown) or other means of operably connecting the docking member 220 to an inside surface of a dryer. The perimeter 223 of the docking member 220 includes a rail portion 224 bordering the docking member 220 along two sides, which may protect the corresponding edges of the fabric conditioning block 210, when the fabric conditioning block 210 is operably connected the docking member 220. The docking member 220 also includes fin receiving members 225 and one or two securing tabs 226 as connecting members. The fin receiving members 225 extend from the rail portion 224 along two sides. The securing tab(s) 226 is at the end(s) of the docking member 220. When the fabric conditioning block 210 is slid into the docking member 220 from either end, the securing tab 226 is pushed downward and then snaps into place to border the corresponding edge of the composition carrier 230 when operably connected to the first side 221 of the docking member 220. The securing fins 235 are arranged similarly as the fin receiving members 225 on the docking member 220. Therefore, the block 210 does not have to be slid into the docking member 220 all the way from an end of the block 210. Rather, the securing fins 235 and the corresponding fin receiving members 225 are simply placed in the spaces between the fin receiving members 225 thereby depressing the securing tab 226 concurrently. As the block 210 is slid in the docking member 220 so the fin receiving members 225 align with the securing fins 235, the securing tab 226 engages the end of the block 210 thereby snap locking it into place. This provides a shorter distance to connect the block 210 to the docking member 220 should; for example, the walls of the dryer prevent the block 210 from being slid into place from the end of the docking member 220. To disengage the block 210 from the docking member 220, the securing tab 226 is pushed downward and then the block 210 is slid away from the fin receiving members 225 of the docking member 220. When the securing fins 235 of the composition carrier 230 no longer align with the fin receiving members 225 of the docking member 220, the block 210 may be removed from the docking member 220. In one embodiment, the docking includes one securing tap 226 at one end of the docking member, while the rail portion 224 is extended to the other end to protect one end of the composition carrier 230. In one embodiment depicted in FIG. 3, the docking member 220 includes two securing taps 226 situated at both ends of the docking member. This arrangement allows block 210 to be attached from both ends of the docking member 220.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric conditioner dispenser comprising:

a composition carrier capable of releasing a fabric conditioning composition wherein the composition carrier comprises a circumferential edge comprises at least two securing fins;

wherein the fabric conditioning composition is operatively attached to the composition carrier;

a docking member comprising: (a) at least two fin receiving members capable of receiving the two securing fins of the composition carrier; (b) at least two securing taps capable of engaging the ends of the composition carrier; (c) and free of a rail portion on both ends of the docking member;

wherein the at least two securing taps are capable of being pushed downward and the snap into place to border the corresponding edge of the composition carrier;

wherein the docking member is capable of being releasably attached to an inner surface of a clothes dryer;

wherein said composition carrier is operatively attached and unattached to said docking member by horizontally sliding the composition carrier into or out of the docking member on either end of the docking member that is free of a said rail portions, respectively.

2. The fabric conditioner dispenser of claim 1, wherein the docking member further comprises rail portion bordering the docking member along two sides but is free of the rail portion on both ends of the docking member.

* * * * *

UNITED STATES PATENT AND TRADEMARK OFFICE

CERTIFICATE OF CORRECTION

PATENT NO. : 7,980,001 B2
APPLICATION NO. : 11/059061
DATED : July 19, 2011
INVENTOR(S) : Trinh et al.

It is certified that error appears in the above-identified patent and that said Letters Patent is hereby corrected as shown below:

Column 10

Line 38, after the word and, delete "the".

Signed and Sealed this
Second Day of October, 2012

David J. Kappos

David J. Kappos
*Director of the United States Patent and Trademark Office*